US007159910B2

(12) United States Patent
Hwang

(10) Patent No.: US 7,159,910 B2
(45) Date of Patent: Jan. 9, 2007

(54) APPARATUS FOR OPENING/CLOSING DOOR OF DRYER

(75) Inventor: Sung Gi Hwang, Changwon-si (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/721,340

(22) Filed: Nov. 26, 2003

(65) Prior Publication Data

US 2004/0104582 A1 Jun. 3, 2004

(30) Foreign Application Priority Data

Nov. 29, 2002 (KR) ..... 10-2002-0075327

(51) Int. Cl.
*E05B 15/02* (2006.01)

(52) U.S. Cl. ..... 292/341.15; 292/302

(58) Field of Classification Search ..... 292/340, 292/341.15, 300, 302, 303, 4, 5, 8, 9, 12, 292/13

See application file for complete search history.

(56) References Cited

U.S. PATENT DOCUMENTS 711,812 A 10/1902 Armstrong ..... 24/657
2,380,568 A * 7/1945 Adams ..... 248/501
2,478,434 A 8/1949 Swanson ..... 292/31
2,526,539 A * 10/1950 Carroll ..... 292/17
2,592,073 A 4/1952 Schwarzkopf ..... 292/175
2,629,156 A * 2/1953 Kamens et al. ..... 24/657
2,869,952 A * 1/1959 Saunders ..... 312/405
3,603,631 A * 9/1971 White ..... 292/220
5,096,236 A * 3/1992 Thony ..... 292/32
6,082,787 A * 7/2000 Chioffi et al. ..... 292/128

* cited by examiner

*Primary Examiner*—Gary Estremsky
(74) *Attorney, Agent, or Firm*—Birch, Stewart, Kolasch & Birch, LLP

(57) ABSTRACT

An apparatus for opening and/or closing a dryer door wherein the door is opened and/or closed more simply and swiftly. The present invention includes a hook provided at one side of the dryer door wherein a hanging portion is formed at both sides of one end of the hook. A latch body is provided to one side of a front panel having the door installed thereon, and the hanging portion is inserted in an insertion hole formed in the latch body. A pair of holders is provided to confront each other in the latch body to hold the hanging portion, and a pair of springs is provided in the rear of the holders, respectively.

17 Claims, 6 Drawing Sheets

APPARATUS FOR OPENING/CLOSING DOOR OF DRYER

This application claims the benefit of Korean Application (s) No. 10-2002-0075327 filed on Nov. 29, 2002 which is/are hereby incorporated by reference.

BACKGROUND OF THE INVENTION

1. Field of the Invention

The present invention relates to an apparatus for opening/closing a door of a drier, by which the door is swiftly and conveniently opened/closed.

2. Discussion of the Related Art

Generally, a washing machine is an apparatus for eliminating filth from a laundry by performing washing, rinsing, and dewatering steps using friction between the laundry and a current of water. Lately, a washing machine equipped with a drying function as well as a washing function and a drier for performing the drying function only are widely used.

FIG. 1 is a perspective view of a drier according to a related art.

Referring to FIG. 1, a drier according to a related art consists of a case 2, a drum 4, a heater (not shown in the drawing), and a motor (not shown in the drawing).

An opening 2*a* via which a laundry is put in or pulled out of the drum 4 is formed at a front side of the case 2. The drum 4 is rotatably installed in the case 2 to communicate with the opening 2*a*. A plurality of lifters 3 protrude from an inside of the drum 4 to lift the laundry in the drum 4 to fall.

The heater (not shown in the drawing) generating hot air for drying the laundry and the motor (not shown in the drawing) for rotating the drum 4 are installed outside the drum 4.

The case 2 consists of a cabinet 32, a front panel 33, a top cover 35, and a control panel 36.

The front panel 33 having the opening 2*a* formed at its front side is provided to a front side of the cabinet 32. The top cover 35 is provided to a top of the cabinet 32. The control panel 36 is provided on a rear top of the top cover 35. And, electronic units for controlling the drier are installed in the control panel 36.

Meanwhile, a door 10 is provided at one side of the opening 2*a* in the front panel 33 to open/close the opening 2*a*.

The door 10 consists of a hook 30 and a latch assembly 34. The hook 30 is fixed to one side of the door 10 using screws 31, and the latch assembly 34 is fixed to one side of the front panel 33 using screws 34*a*. And, the door 10 is provided to a hinge 12 fixed to the front panel 33 in the vicinity of the opening 2*a* to revolve centering around the hinge 12.

The latch assembly 34 locks or unlocks the hook 30 installed at the door 10 according to a signal of a control unit. In this case, a user freely enables to open/close the door 10 while power is not applied to a door lock switch separately installed at one side of the drier.

Meanwhile, while the door 10 is closed and the power is applied to the door lock switch, the latch assembly 34 keeps locking the hook 30 so that the door 10 is unable to be opened.

However, the related art drier has the following problem or disadvantage.

First of all, the drier differs from a washing machine in that water is not held in the drier. Hence, the user needs to open the door in order to put more dry objects in the drier in progress or in order to check a drying state of the laundry while the drier operates. In this case, the structure of the apparatus for opening/closing the door of the drier is equal or similar to that of the washing machine. Hence, it is inconvenient or takes pains to open/close the door.

SUMMARY OF THE INVENTION

Accordingly, the present invention is directed to an apparatus for opening/closing a door of a drier that substantially obviates one or more of the problems due to limitations and disadvantages of the related art.

An object of the present invention, which has been devised to solve the foregoing problem, lies in providing an apparatus for opening/closing a door of a drier, by which the door is opened/closed more simply and swiftly.

Additional features and advantages of the invention will be set forth in the description which follows, and in part will be apparent to those having ordinary skill in the art upon examination of the following or may be learned from a practice of the invention. The objectives and other advantages of the invention will be realized and attained by the subject matter particularly pointed out in the specification and claims hereof as well as in the appended drawings.

To achieve these objects and other advantages in accordance with the present invention, as embodied and broadly described herein, there is provided an apparatus for opening/closing a door of a drier includes a hook provided at one side of the door of the drier wherein a hanging portion is formed at both sides of one end of the hook, a latch body provided to one side of a front panel having the door installed thereon wherein the hanging portion is inserted in an insertion hole formed in the latch body, a pair of holders provided to confront each other in the latch body to hold the hanging portion, and a pair of springs provided in rear of the holders, respectively.

In this case, the latch body includes a first reception part receiving the hanging portion and a pair of second reception parts provided adjacent to both sides of the first reception part to hold to guide the holders, respectively. And, a pair of passing holes communicating with the second reception parts are formed at both of the sides of the first reception part to let the holders pass through, respectively.

Moreover, a recess (step) is formed at one end of each of the second reception parts to support the corresponding spring. And, a hanging protrusion is formed on one side of each of the holders to be held by an upper end of the first reception part.

Meanwhile, the hanging portion has a triangular cross-section. In this case, confronting planes of the holders are inclined to correspond to the triangular cross-section of the hanging portion.

And, a surface of the hanging portion to be brought contact with the holders is rounded. And, two confronting ends of the holders are rounded.

Moreover, a hollow portion is provided at a rear side of each of the holders to have one end of the corresponding spring inserted therein.

Meanwhile, the apparatus further includes a latch cap covering the first and second reception parts to prevent separation of the holders and the springs.

In this case, fixing protrusions protrude from a bottom of the latch cap to hold one ends of the springs, respectively. And, guide protrusions protrude from a bottom of the latch cap to guide to move the holders, respectively.

Moreover, coupling holes are formed at corners of the lath cap and wherein bolts are screwed in the coupling holes, respectively to fix the latch cap to the latch body. And, the hook is built in one body of a fixing plate screw-coupled to one side of the door.

And, coupling holes are formed at both sides of the latch body and wherein bolts are screwed in the coupling holes, respectively to fix the latch body to the front panel.

It is to be understood that both the foregoing explanation and the following detailed description of the present invention are exemplary and illustrative and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE PREFERRED EMBODIMENT(S)

Reference will now be made in detail to the preferred embodiment(s) of the present invention, examples of which are illustrated in the accompanying drawings. Throughout the drawings, like elements are indicated using the same or similar reference designations where possible.

Figure 1:
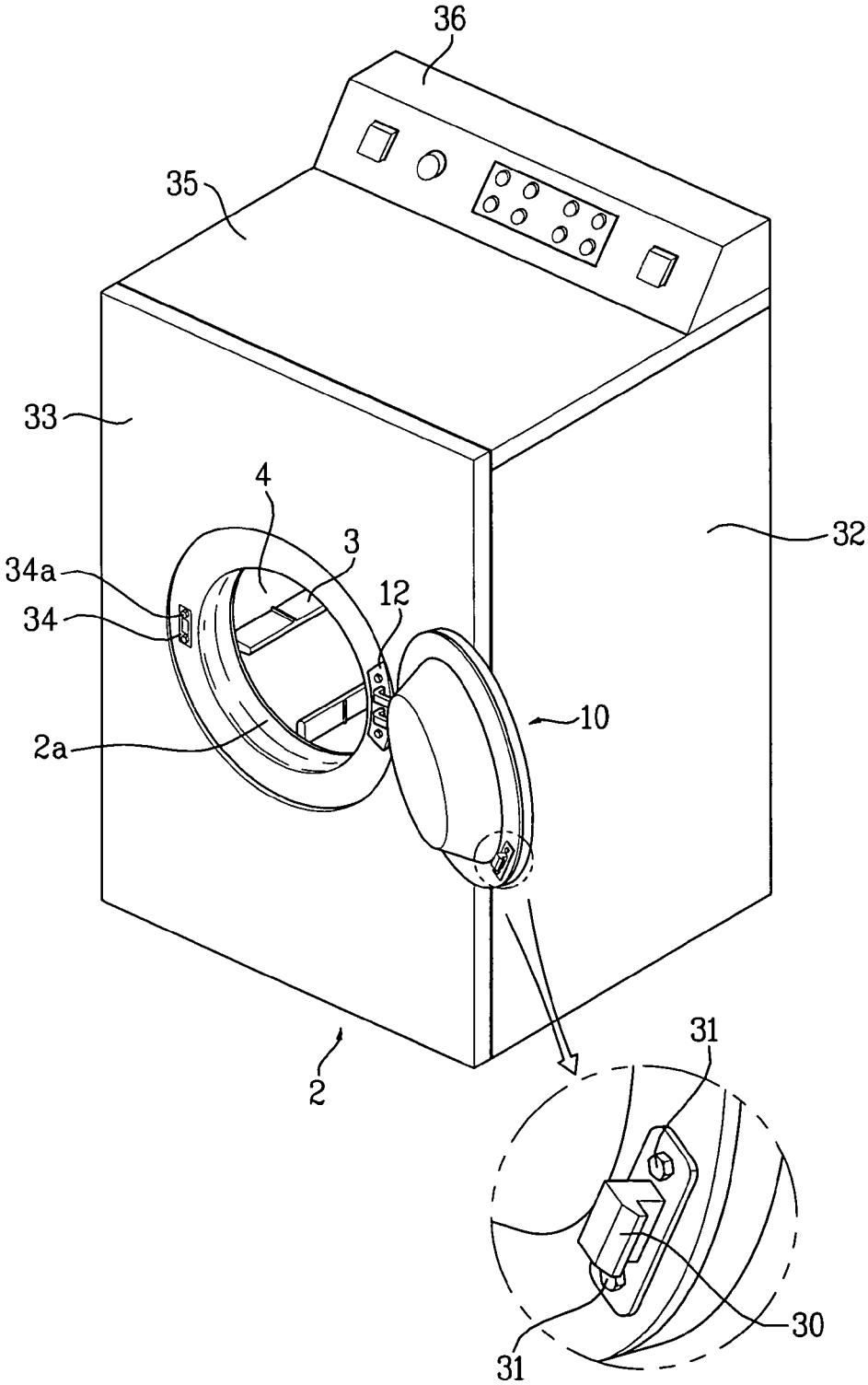
FIG. 1 Prior Art
FIG. 1 is a perspective view of a drier according to a related art.
Figure 2:
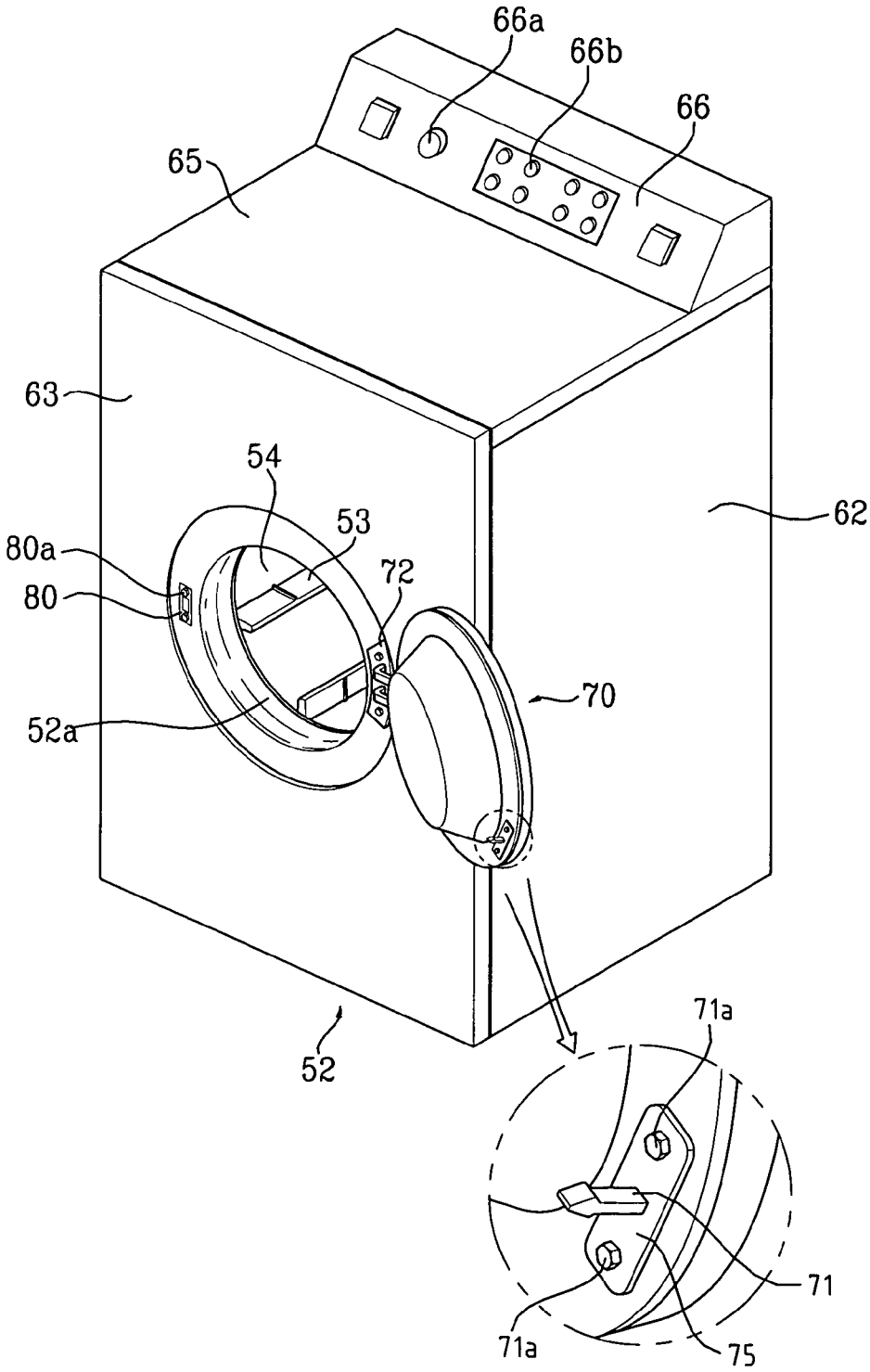
FIG. 2 is a perspective view of a drier according to one embodiment of the present invention.

FIG. 2 is a perspective view of a drier according to one embodiment of the present invention.

Referring to FIG. 2, a drier according to one embodiment of the present invention includes a case 52, a drum 54, a heater (not shown in the drawing), a motor (not shown in the drawing), and a door 70.

An opening 52*a* is formed at a front side of the case 52. The drum 54 is provided in the case 52 to hold a laundry inside. A plurality of lifters 53 are provided to protrude from an inner circumference of the drum 54 to lift the laundry in the drum 54 to fall.

The heater (not shown in the drawing) generating dry hot air for drying the laundry is provided outside the drum 54. And, the dry hot air is blown into the drum 54 by a fan (not shown in the drawing). The motor (not shown in the drawing) for rotating the drum 54 is provided outside the drum 4 to rotate the drum 54.

The case 52 includes a cabinet 62, a front panel 63, a top cover 65, and a control panel 66.

The front panel 63 having the opening 52*a* formed at its center is provided to a front side of the cabinet 62. The top cover 65 is provided to a top of the cabinet 62. The control panel 66 is provided on a rear top of the top cover 65. An operation control unit 66*a* for controlling an operation of the drier and an operation display unit 66*b* are installed on a front side of the control panel 66, and electronic units for controlling the drier are loaded in the control panel 66.

Meanwhile, the door 70 is provided at one side of the opening 52*a* in the front panel 63 to open/close the opening 52*a*. And, the door 70 is provided to a hinge 72 fixed to the front panel 63 in the vicinity of the opening 52*a* to revolve centering around the hinge 72.

Figure 3:
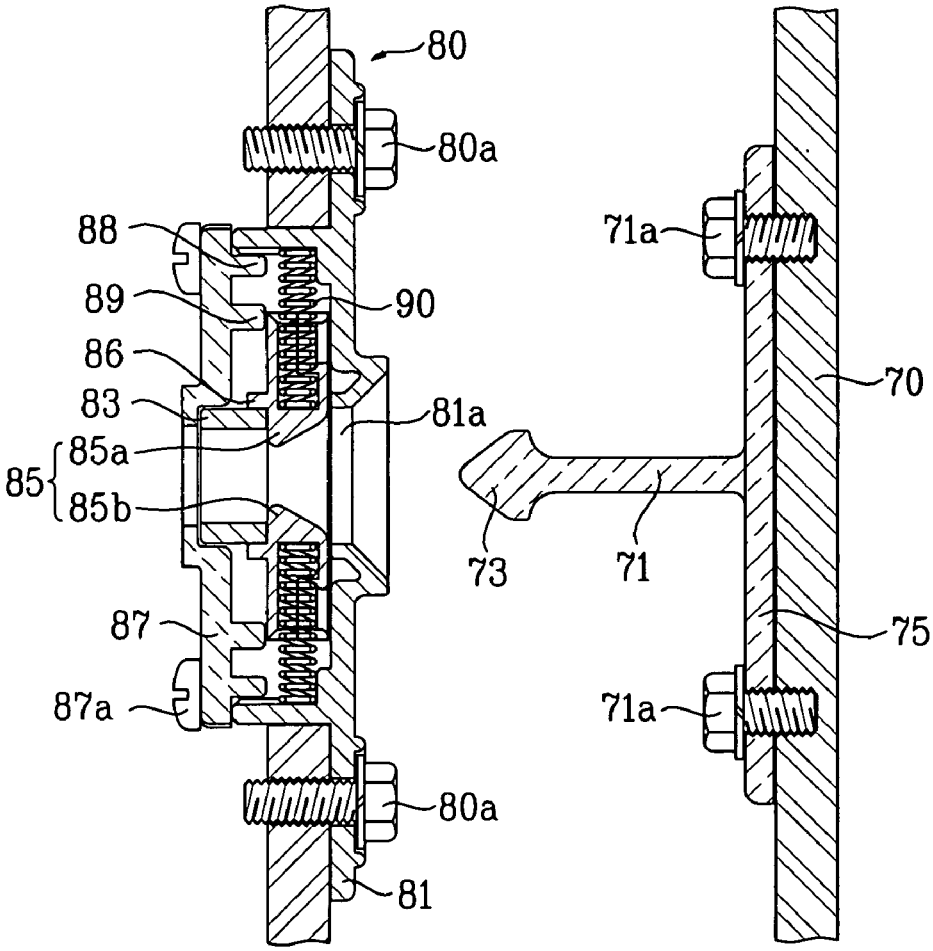
FIG. 3 is a cross-sectional view of an apparatus for opening/closing a door according to the present invention.

FIG. 3 is a cross-sectional view of an apparatus for opening/closing a door according to the present invention.

Referring to FIG. 3, the door 70 includes a hook 71 having a hanging portion 73 of which cross-section of one end is triangular and a latch assembly 80.

The hook 71 is formed to protrude from a fixing plate 75 fixed to the door 70. The fixing plate 75 is fixed to a portion of the door 70 opposite to the other portion coupled to the hinge 63 using bolts 71*a*. And, the hanging portion 73 is formed at one end of the hook 71 to have the triangular cross-section.

Moreover, the latch assembly 80 for catching the hook 71 thereon is fixed to the front panel 63 using bolts 80*a*.

The latch assembly 80 includes a latch body 81, a holder 85, springs 90, and a latch cap 87.

The latch body 81 includes an insertion hole 81*a* in which the hook 71 is inserted. The holder 85 is provided with a pair confronting each other in the latch body 81, and two confronting one ends of the holder 85 are slant to form incline planes, respectively. The hanging portion 73 of the hook 71 is inserted in the latch body 81 by sliding in along the incline planes so as to be held by the holder 85. A pair of the springs 90 are provided to the other ends of the holder 85, respectively. The springs 90 are elastically deformed when the hanging portion 73 is inserted, whereby the holder 85 moves backward. And, the latch cap 87 is coupled to a rear side of the latch body 81 to prevent the separation of the holder 85 and the springs 90.

A coupling mechanism between the hook 71 and the latch assembly 80 is explained in detail as follows.

First of all, the hanging portion 73 protruding triangularly is provided to the tip of the hook 71, and the incline planes provided to the one ends of the holder 85 correspond to an incline plane of the hanging portion 73.

The holder 85, as shown in FIG. 3, includes first and second holders 85*a* and 85*b* provided at both sides of the latch body 81 to confront each other.

When the door 70 is closed, the hanging portion 73 of the hook 71 is inserted in the latch body 81 via the insertion hole 81*a*. The hanging portion 73 is inserted to slide along the incline planes of the first and second holders 85*a* and 85*b*. In this case, the first and second holders 85*a* and 85*b* move backward as the springs 90 are elastically contracted by the insertion of the hanging portion 73. Once such an insertion is completed, the springs 90 return to original positions, respectively, and a rear end of the hanging portion 73 is caught on the first and second holders 85*a* and 85*b*. Hence, the hook 71 is fixed to the latch assembly 80 so that the door 70 maintains to be closed.

Moreover, tips of the holder 85 are rounded, and a surface 73*a* of the hanging portion 73 contacted with the tips of the holder 85 to be held is rounded as well. Hence, if the door 70 is pulled by a certain force, the springs 90 are compressed to move the holder 85 backward so that the user enables to open the door 70 conveniently.

Figure 4:
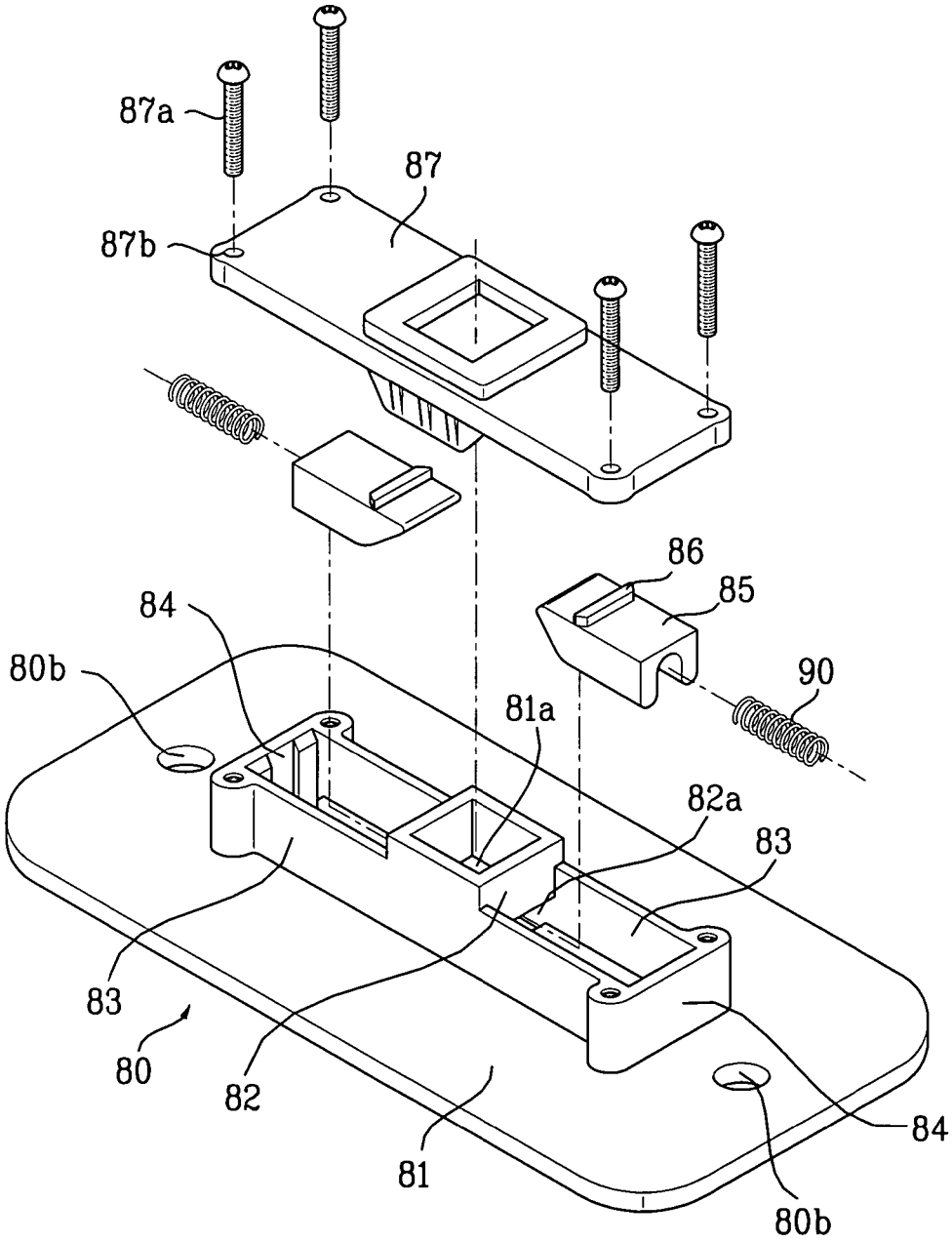
FIG. 4 is a perspective view of a disassembled latch assembly according to the present invention.
Figure 5:
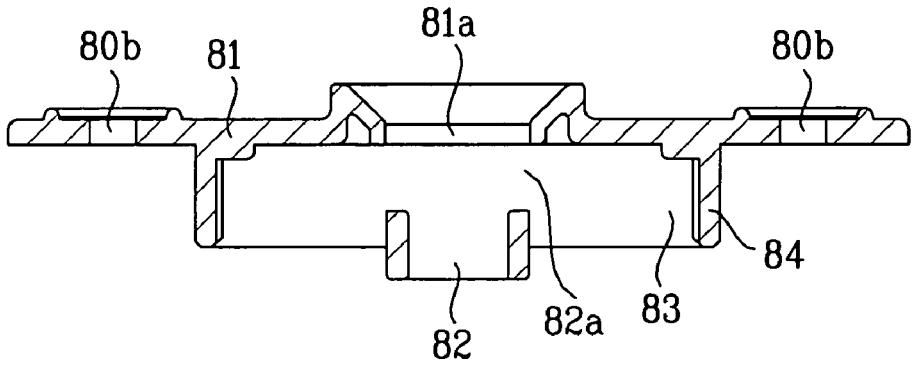
FIG. 5 is a cross-sectional view of a latch assembly according to the present invention.

FIG. 4 is a perspective view of a disassembled latch assembly according to the present invention and FIG. 5 is a cross-sectional view of a latch assembly according to the present invention.

Referring to FIG. 4 and FIG. 5, a rectangular first reception part 82 is formed on a central portion of the latch body 81, and the hook 71 is inserted in the first reception part 82. A pair of passing holes 82*a* are formed at both sides of the first reception part 82 to communicate with a pair of second reception parts 83, respectively. The second reception parts 83 are provided adjacent to both sides of the first reception part 82, respectively to hold and guide the holder 85. Hence, the holder 85 communicates between the first and second reception parts 82 and 83 through the passing holes 82*a*.

A support 84 is formed at an end of each of the second reception parts 83 to support one end of the corresponding spring 90. A center of the support 84 is recessed to provide a step so that a loaded location of the corresponding spring 90 is fixed thereto, whereby the corresponding spring 90 loaded in the latch body 81 is prevented from fluctuating.

Each portion of the holder 85 to be brought contact with the hanging portion 73 is formed slant to correspond to the hanging portion 73. Hence, once the hanging portion 73 of the hook 71 is inserted, a gap between the first and second holders 85*a* and 85*b* is easily widened by the elastic deformation of the springs 90. And, a hollow portion is formed inside each of the first and second holders 85*a* and 85*b* to have one end of the corresponding spring 90 inserted therein.

Referring to FIG. 3 and FIG. 4, a hanging protrusion 86 formed at one side of each of the first and second holders 85*a* and 85*b* is held by one corresponding side of the first reception part 82, whereby a predetermined gap is always maintained between the first and second holders 85*a* and 85*b*. Hence, the hanging portion 73 of the hook 71 is inserted in the gap to be fixed thereto.

A pair of fixing protrusions 88 protrude from a bottom of the latch cap 87 to hold one ends of the springs 90, respectively. The fixing protrusions 88 fix the springs 90 not to be separated from the second reception parts 83, respectively.

Moreover, the latch cap 87 is provided to leave a predetermined distance from the holder 85. A pair of guide protrusions 89 protruding from the bottom of the latch cap 87 are brought contact with the one corresponding sides of first and second holders 85*a* and 85*b* to guide the holder 85 to slide in and out.

An exterior of the latch assembly 80 is explained as follows.

Figure 6:
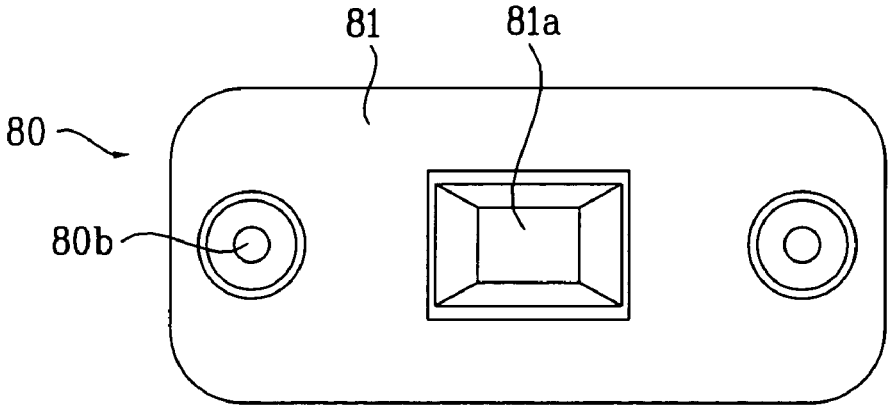
FIG. 6 is a layout of a latch assembly according to the present invention.
Figure 7:
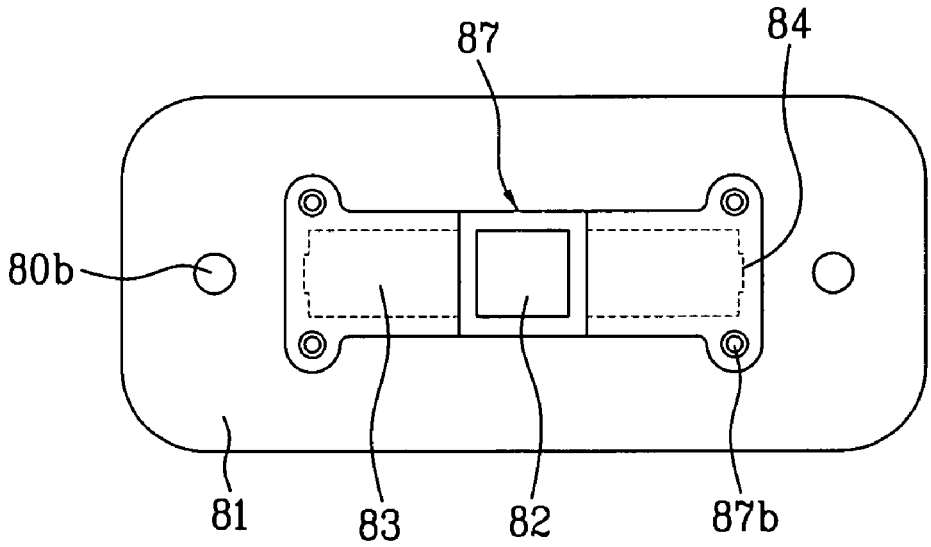
FIG. 7 is a rear view of a latch assembly according to the present invention.

FIG. 6 is a layout of a latch assembly according to the present invention and FIG. 7 is s a rear view of a latch assembly according to the present invention.

Referring to FIG. 6, the insertion 81*a* is formed in the latch body 81 provided on the front side of the latch assembly 80. The hanging portion 73 of the hook 71 is inserted through the insertion hole 81*a*. Moreover, bolt coupling holes 80*b* are formed at both ends of the latch body 81. Bolts are screwed in the bolt coupling holes 80*b* so that the latch body 81 is fixed to the front panel 63 in the vicinity of the opening 52*a*.

Referring to FIG. 7, the first reception part 82 and a pair of the second reception parts 83 protrude from a rear side of the latch body 81, and the first and second reception parts 82 and 83 are covered with the latch cap 87. Hence, one side of the front panel 63 where the latch assembly 80 is installed is partially recessed inward to correspond to protruding portions of the first and second reception parts 82 and 83.

An operation of the apparatus for opening/closing the door of the drier according to the present invention is explained as follows.

First of all, when the door is closed after the laundry has been put in the drier, the hanging portion 73 of the hook 71 is inserted through the insertion hole 81*a* of the latch assembly 80. As the hanging portion 73 of the hook 71 is inserted, the holder 85 loaded in the latch assembly 80 moves backward. Namely, as the hanging portion 73 is inserted, the gap between the first and second holders 85*a* and 85*b* gets widened.

After the insertion of the hanging portion 73, the first and second holders 85*a* and 85*b* return to their original positions by the elasticity of the springs 90 so as to hold to fix the hanging portion 73. Once the door 70 is closed, a drying step of the drier is executed. Meanwhile, the portion of the hanging portion 73 coming into contact with the holder 85 is rounded. Pulled by a certain force, the hanging portion 73 slides out to be released from the holder 85. Thus, the user pulls the door 70 by the certain force to open.

Accordingly, the apparatus for opening/closing the door of the drier according to the present invention has the following advantages or effects.

First of all, the confronting first and second holders hold the hanging portion of the hook having the triangular cross-section. And, the springs are provided to the rear ends of the first and second holders, whereby the door can be easily opened by being pulled with a certain force. Namely, the user just pulls the door with a predetermined force to open the door conveniently. Therefore, the present invention provides the apparatus for opening/closing the door, by which the user can open the door of the dire in progress in order to put in more objects to be dried or to check a drying state of the laundry.

It will be apparent to those skilled in the art that various modifications and variations can be made in the present invention without departing from the spirit or scope of the invention. Thus, it is intended that the present invention cover such modifications and variations, provided they come within the scope of the appended claims and their equivalents.

What is claimed is:

1. A dryer latch for opening/closing a door of a dryer that includes a front panel having the door installed thereon, comprising:

a hook adapted to be provided at one side of the door of the dryer wherein a hanging portion is formed at both sides of one end of the hook;

a latch body adapted to be provided to one side of the front panel having the door installed thereon wherein the hanging portion is inserted in an insertion hole formed in the latch body;

a pair of holders linearly slidable in the latch body to confront each other in the latch body to directly hold the hanging portion; and a pair of springs provided in the rear of the holders, respectively, wherein the latch body comprises:

a planar base part;

a first reception part having side wall portions protruding from the planar base part for receiving the hanging portion; and a pair of second reception parts provided adjacent to opposing side walls of the first reception part to at least partially contain and guide the holders and springs respectively, and wherein a protrusion is located on one side of each of the holders to be held against sliding in the latch body by one of the side wall portions of the first reception part.

2. The dryer latch as claimed in claim 1, wherein a pair of passing holes communicating with the second reception parts are formed at both of the side wall portions of the first reception part to let the holders pass through, respectively.

3. The dryer latch as claimed in claim 1, wherein a recess is formed at one end of each of the second reception parts to support the corresponding spring.

4. The dryer latch as claimed in claim 1, wherein the hanging portion formed at both sides of one end of the hook has a triangular cross-section.

5. The dryer latch as claimed in claim 4, wherein confronting planes of the holders are inclined to correspond to the triangular cross-section of the hanging portion.

6. The dryer latch as claimed in claim 1, wherein a surface of the hanging portion to be brought in contact with the holders is rounded.

7. The dryer latch as claimed in claim 6, wherein two confronting ends of the holders are rounded.

8. The dryer latch as claimed in claim 1, wherein a hollow portion is provided at a rear side of each of the holders to have one end of the corresponding spring inserted therein.

9. The dryer latch as claimed in claim 1, wherein the hook is built in one body of a fixing plate screw-coupled to one side of the door.

10. The dryer latch as claimed in claim 1, wherein coupling holes are formed at both sides of the latch body and wherein bolts are in the coupling holes, respectively, to fix the latch body to the front panel.

11. The combination of a laundry dryer and the dryer latch of claim 1.

12. A door latch for opening/closing a door of a dryer that includes a front panel having the door installed thereon, comprising:

a hook adapted to be provided at one side of the door of the dryer wherein a hanging portion is formed extending from both sides of one end of the hook;

a latch body adapted to be provided to one side of the front panel having the door installed thereon wherein the latch body comprises a planar base part and reception parts that protrudes from the planar base part, one reception part adapted to receive the hanging portion and other reception parts adapted to contain a pair of holders and a pair of springs;

the pair of holders adapted to be provided to confront each other in the latch body to hold the hanging portion;

the pair of springs provided in the rear of the holders, respectively; and a latch cap attachable to the latch body to cover the other reception parts of the latch body to prevent separation of the holders and the springs from the latch body.

13. The dryer latch as claimed in claim 12, wherein fixing protrusions protrude from a bottom of the latch cap to hold one ends of the springs, respectively.

14. The combination of a laundry dryer and the dryer latch of claim 13.

15. The dryer latch as claimed in claim 12, wherein guide protrusions protrude from a bottom of the latch cap to guide movement of the holders, respectively.

16. A dryer door latch for opening/closing a door of a dryer that includes a front panel having the door installed thereon, comprising:

a hook provided at one side of the door of the dryer wherein a portion is formed at both sides of one end of the hook;

a latch body provided to one side of the front panel having the door installed thereon wherein the portion is inserted in an insertion hole formed in the latch body;

a pair of holders provided to confront each other in the latch body to hold the hanging portion;

a pair of springs provided in the rear of the holders, respectively;

a latch cap covering first and second reception parts to prevent separation of the holders and the springs; and wherein coupling holes are formed at corners of the latch cap and wherein bolts are in the coupling holes, respectively, to fix the latch cap to the latch body.

17. The combination of a laundry dryer and the dryer latch of claim 16.

* * * * *